US008575527B2

(12) United States Patent
Fry

(10) Patent No.: US 8,575,527 B2
(45) Date of Patent: Nov. 5, 2013

(54) VEHICLE HAVING SIDE PORTHOLES AND AN ARRAY OF FIXED EO IMAGING SUB-SYSTEMS UTILIZING THE PORTHOLES

(75) Inventor: James A. Fry, Orlando, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 315 days.

(21) Appl. No.: 12/943,651

(22) Filed: Nov. 10, 2010

(65) Prior Publication Data

US 2012/0111992 A1 May 10, 2012

(51) Int. Cl.

| | |
|---|---|
| ***F41G 7/22*** | (2006.01) |
| ***G06K 9/20*** | (2006.01) |
| *F41G 7/00* | (2006.01) |
| *G06K 9/00* | (2006.01) |

(52) U.S. Cl.

USPC ..... 244/3.16; 244/3.1; 244/3.15; 244/3.19; 342/52; 342/53; 342/61; 342/62; 382/100; 382/103; 382/106; 382/107

(58) Field of Classification Search

USPC ..... 244/3.1–3.3; 382/100, 103, 106, 107; 102/200, 206, 211, 213; 342/52–55, 342/61, 62, 175, 176, 179, 195

See application file for complete search history.

(56) References Cited

U.S. PATENT DOCUMENTS

| | | | | | |
|---|---|---|---|---|---|
| 1,735,108 | A | | 11/1929 | Cox | |
| 2,823,612 | A | * | 2/1958 | Cox et al. | 244/3.16 |
| 3,025,023 | A | * | 3/1962 | Barghausen | 244/3.18 |
| 3,133,250 | A | * | 5/1964 | Molmud | 244/3.14 |
| 3,253,525 | A | | 5/1966 | Merkel | |
| 3,362,657 | A | * | 1/1968 | McDaniel | 244/3.19 |
| 3,507,565 | A | | 4/1970 | Alvarez | |
| 3,721,410 | A | * | 3/1973 | Anspacher | 244/3.14 |
| 3,778,007 | A | * | 12/1973 | Kearney et al. | 244/3.14 |
| 3,786,757 | A | * | 1/1974 | Goldstein et al. | 244/3.16 |
| 3,793,958 | A | * | 2/1974 | Holt et al. | 244/3.16 |
| 3,884,548 | A | | 5/1975 | Linder | |
| 4,162,052 | A | * | 7/1979 | Lamelot | 244/3.16 |
| 4,465,940 | A | * | 8/1984 | Graff et al. | 244/3.16 |
| 4,717,822 | A | * | 1/1988 | Byren | 244/3.16 |
| 4,770,370 | A | * | 9/1988 | Pinson | 244/3.12 |
| 4,965,453 | A | * | 10/1990 | Hoschette et al. | 244/3.16 |
| 5,109,425 | A | * | 4/1992 | Lawton | 382/107 |
| 5,274,236 | A | * | 12/1993 | Pascale et al. | 244/3.16 |

(Continued)

*Primary Examiner* — Bernarr Gregory

(74) *Attorney, Agent, or Firm* — Terry M. Sanks, Esq.; Beusse Wolter Sanks Mora & Maire, P.A.

(57) ABSTRACT

A vehicle including electro-optic (EO) imaging has a vehicle body having an outer surface including a front portion and a side portion, wherein the side portion includes a plurality of portholes. A propulsion source is within the vehicle body for moving the vehicle. A fixed EO imaging system having a field-of-regard (FOR) includes a plurality of fixed EO imaging sub-systems arrayed within the vehicle body. The fixed EO imaging sub-systems each have a different field-of-view (FOV) for providing a portion of the FOR and include a camera affixed within the vehicle body and an optical window secured to one of the portholes for transmitting electromagnetic radiation received from one of the portions of the FOR to the camera, wherein the cameras each generate image data representing one of the portions of the FOR therefrom. A processor is coupled to receive the image data from the plurality of fixed EO imaging sub-systems for combining the image data to provide composite image data spanning the FOR.

15 Claims, 6 Drawing Sheets

(56) References Cited

U.S. PATENT DOCUMENTS

| | | | | | |
|---|---|---|---|---|---|
| 5,368,254 | A | * | 11/1994 | Wickholm | 244/3.16 |
| 5,372,333 | A | * | 12/1994 | Uwira et al. | 244/3.16 |
| 5,374,009 | A | * | 12/1994 | Miller et al. | 244/3.13 |
| 5,418,364 | A | * | 5/1995 | Hale et al. | 244/3.16 |
| 5,452,030 | A | | 9/1995 | Feinbloom | |
| 5,467,942 | A | * | 11/1995 | Abbas et al. | 244/3.17 |
| 5,526,181 | A | | 6/1996 | Kunick et al. | |
| 5,647,560 | A | * | 7/1997 | Schnatz et al. | 244/3.15 |
| 5,764,192 | A | | 6/1998 | Fowler et al. | |
| 5,793,332 | A | | 8/1998 | Fowler et al. | |
| 5,892,855 | A | * | 4/1999 | Kakinami et al. | 382/103 |
| 5,932,833 | A | * | 8/1999 | Hammon et al. | 244/3.16 |
| 5,936,771 | A | | 8/1999 | Cooper | |
| 6,076,765 | A | * | 6/2000 | Horwath | 244/3.16 |
| 6,121,606 | A | * | 9/2000 | Voigt et al. | 244/3.16 |
| 6,198,564 | B1 | * | 3/2001 | Knight | 244/3.16 |
| 6,201,230 | B1 | | 3/2001 | Crowther et al. | |
| 6,310,730 | B1 | | 10/2001 | Knapp et al. | |
| 6,343,767 | B1 | | 2/2002 | Sparrold et al. | |
| 6,344,937 | B1 | | 2/2002 | Sparrold et al. | |
| 6,357,695 | B1 | * | 3/2002 | Horwath | 244/3.16 |
| 6,398,155 | B1 | * | 6/2002 | Hepner et al. | 244/3.15 |
| 6,422,508 | B1 | * | 7/2002 | Barnes | 244/3.16 |
| 6,565,036 | B1 | * | 5/2003 | Palathingal et al. | 244/3.16 |
| 6,584,211 | B1 | * | 6/2003 | Amemiya et al. | 382/103 |
| 6,654,481 | B2 | * | 11/2003 | Amemiya et al. | 382/103 |
| 6,765,644 | B1 | | 7/2004 | Anderson et al. | |
| 6,766,979 | B2 | * | 7/2004 | Horwath | 244/3.17 |
| 6,817,569 | B1 | * | 11/2004 | Horwath | 244/3.17 |
| 7,040,570 | B2 | * | 5/2006 | Sims et al. | 244/3.16 |
| 7,425,693 | B2 | * | 9/2008 | Shapira | 244/3.1 |
| 7,450,735 | B1 | * | 11/2008 | Shah et al. | 382/103 |
| 7,494,089 | B2 | * | 2/2009 | Williams et al. | 244/3.16 |
| 7,575,190 | B2 | * | 8/2009 | Sallee | 244/3.16 |
| 7,623,676 | B2 | * | 11/2009 | Zhao et al. | 382/103 |
| 7,624,941 | B1 | * | 12/2009 | Patel et al. | 244/3.22 |
| 7,673,565 | B1 | * | 3/2010 | Proctor | 244/3.16 |
| 7,679,037 | B2 | * | 3/2010 | Eden et al. | 244/3.1 |
| 7,982,662 | B2 | * | 7/2011 | Shaffer | 244/3.1 |
| 8,084,724 | B1 | * | 12/2011 | Brosch et al. | 244/3.16 |
| 8,260,478 | B1 | * | 9/2012 | Green et al. | 244/3.16 |
| 8,267,355 | B1 | * | 9/2012 | Patel et al. | 244/3.21 |
| 2001/0013565 | A1 | * | 8/2001 | Davidovitch | 244/3.16 |
| 2004/0057656 | A1 | | 3/2004 | Chu et al. | |
| 2006/0187322 | A1 | | 8/2006 | Janson et al. | |
| 2007/0024978 | A1 | | 2/2007 | Jackson et al. | |
| 2008/0258063 | A1 | | 10/2008 | Rapanotti | |
| 2010/0060746 | A9 | | 3/2010 | Olsen et al. | |

* cited by examiner

VEHICLE HAVING SIDE PORTHOLES AND AN ARRAY OF FIXED EO IMAGING SUB-SYSTEMS UTILIZING THE PORTHOLES

FIELD

Disclosed embodiments relate to vehicles that include electro-optic imaging systems that eliminate the need to move the imaging system to image a field-of-regard.

BACKGROUND

Electro-optical (EO) imaging systems used for monitoring a wide field-of-regard (FOR) typically include mechanical components for moving the EO system, such as stepper motors for moving the camera. In order to search over a wide FOR, the EO system must generally either be gimbaled or have its field-of-view (FOV) otherwise movable.

Conventional beam-steering arrangements for missiles include an infrared (IR) transmissive dome at the tip of the missile and an EO system behind the dome, and a gimbal that rotates the entire EO system. The dome is typically rotationally symmetric, placed at the tip of the missile, is spherical or conformal in shape, and is selected with aerodynamic performance as the primary design consideration.

A disadvantage of conventional gimbaled EO systems for certain applications is the need for ample amounts of sway space in order to provide the mechanical movement needed to sweep through the FOR, which can impose expensive packaging constraints on other missile attributes. Other disadvantages of conventional gimbaled EO system arrangements can include significant added weight, cost as well as variable system performance.

In some applications, it is not practical to physically move the EO system. For those instances, it would be desirable for the EO system to provide both pan and tilt functionality for the full FOR without requiring any physical movement of any part of the EO system.

SUMMARY

Disclosed embodiments include vehicles having electro-optic (EO) imaging that is fixed in position, comprising a vehicle body having an outer surface including a front portion and a side portion, where the side portion includes a plurality of apertures/openings referred to herein as "portholes." As used herein a "porthole" means a flat or conformal aperture that enables viewing out from the side of a vehicle. The vehicle can be a military vehicle such as a missile, torpedo, bomb, airplane, helicopter, tank or truck.

A propulsion source is within the vehicle body for moving the vehicle. A fixed EO imaging system having a fixed field-of-regard (FOR) comprises a plurality of fixed wide field-of-view (FOV) EO imaging sub-systems arrayed within the vehicle body. As used herein a wide FOV EO sub-system provides a total FOV≥10 degrees. The plurality of fixed wide FOV EO sub-systems work in concert roughly analogous to the workings of threat-warning sensors. As used herein, a "fixed EO imaging system" has no moving parts, and thus lacks motors associated with conventional gimbaled EO imaging systems or with Risley prism-based EO imaging systems.

Each of the fixed EO imaging sub-systems provides a portion of the fixed FOR and comprises a camera affixed within the vehicle body, and an optical window secured to one of the portholes for transmitting electromagnetic radiation received from one of the plurality of portions of the FOR to the camera. The cameras each generate image data representing one of the portions of the FOR. A processor is coupled to receive the image data from the plurality of fixed EO imaging sub-systems for combining the image data to provide composite image data spanning the full FOR. The composite image data can be used to generate an actual image, such as an image on a suitable display device.

Applied to fast moving vehicles such as missiles, portholes on the sides of such vehicles (e.g., missiles) have been recognized by the Inventor to raise a plurality of different design challenges, including mechanical, thermal and aerodynamic-induced optical challenges. As described below, each one of these challenges has been addressed.

Instead of having one gimbaled (or other mechanically scanned) EO imaging system having a single optical window at the front/tip of the vehicle looking down the vehicle's long axis, in disclosed embodiments multiple fixed EO systems referred to herein as EO sub-systems are arrayed about the long axis of the vehicle by adding portholes positioned on the sides of the vehicle (thus off the vehicle's long axis) such that the needed FOR is obtained.

Disclosed embodiments thus enable the replacement of one conventional narrow FOV EO imaging system that is mechanically scanned to provide the needed FOR with a disclosed fixed EO imaging system comprising a plurality of fixed wide FOV EO sub-systems, thereby providing the needed FOR without any moving parts. For missile applications, since the disclosed EO systems are arrayed off the missile axis instead of on the missile axis, significantly, disclosed embodiments enable radome placement at the head of a missile as well as the use of a conformal dome to maximize the speed and range of the missile.

DETAILED DESCRIPTION

Figure 1A:
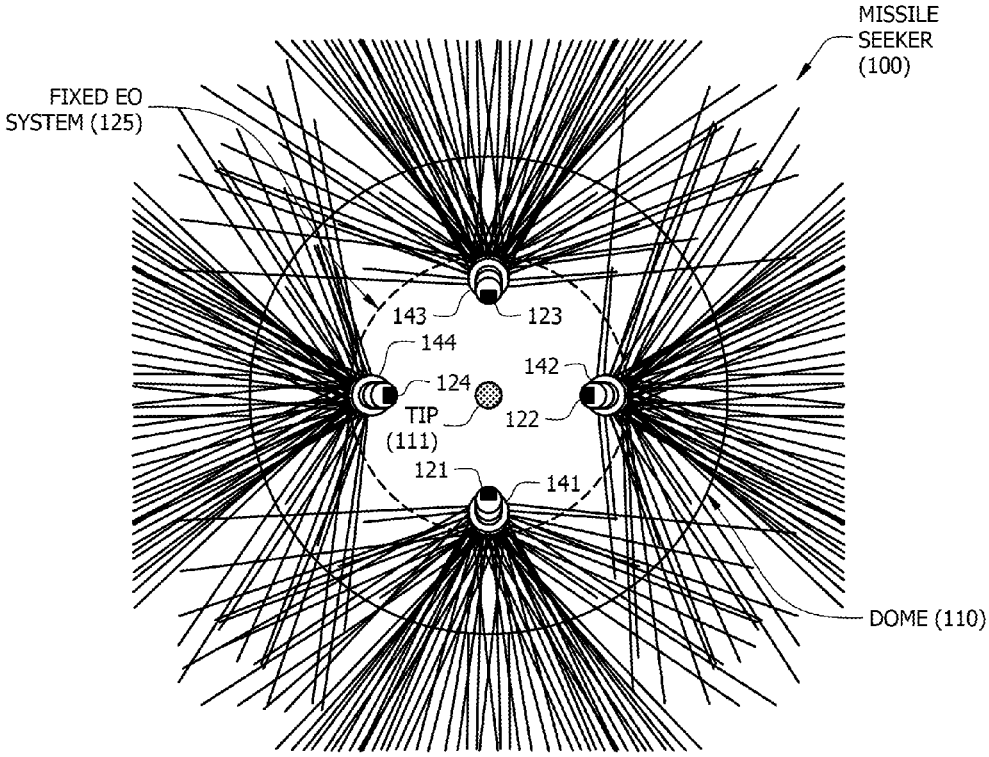
FIG. 1A is a depiction of the front of a missile seeker looking down the missile axis showing a dome having a fixed EO imaging system therein comprising a plurality of fixed wide FOV cameras that enable viewing through portholes formed in the side of the dome, and the resulting combined wide FOR provided, according to a disclosed embodiment.

Disclosed embodiments are described with reference to the attached figures, wherein like reference numerals, are used throughout the figures to designate similar or equivalent elements. The figures are not drawn to scale and they are provided merely to illustrate aspects disclosed herein. Several disclosed aspects are described below with reference to example applications for illustration. It should be understood that numerous specific details, relationships, and methods are set forth to provide a full understanding of the embodiments disclosed herein. One having ordinary skill in the relevant art, however, will readily recognize that the disclosed embodiments can be practiced without one or more of the specific details or with other methods. In other instances, well-known structures or operations are not shown in detail to avoid obscuring aspects disclosed herein. Disclosed embodiments are not limited by the illustrated ordering of acts or events, as some acts may occur in different orders and/or concurrently with other acts or events. Furthermore, not all illustrated acts or events are required to implement a methodology in accordance with this Disclosure.

Notwithstanding that the numerical ranges and parameters setting forth the broad scope of this Disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5.

FIG. 1A is a depiction of the front of a missile seeker 100 looking down the missile axis showing a dome 110 having a fixed EO imaging system 125 therein comprising a plurality of fixed wide FOV fixed EO imaging sub-systems 141, 142, 143 and 144. The dome 110 is formed from a non-infrared (IR) transmissive material. Apertures in the side of the dome 110 referred to herein as portholes 121, 122, 123 and 124 are provided, to allow imaging by EO imaging sub-systems 141, 142, 143 and 144. For certain applications for missile seeker 100, EO seeker operation will be in the IR bands from 3 to 5 μm or from 8 to 12 μm.

EO imaging sub-systems 141, 142, 143, and 144 are sensitive in the IR spectrum and include cameras that are oriented to each generate image data for different FOVs for providing a portion of the wide FOR for EO imaging system 125. As used herein, a "camera" includes one or more lenses and a light sensitive device (e.g., CCD, or photodiode array) at the focal plane. The resulting combined wide FOR provided is shown in FIG. 1A. The tip of the missile seeker 100 is identified as 111.

It is noted that for conventional mechanically swept EO imaging systems the FOR equals the maximum sweep angle plus the maximum optical system FOV. However, using disclosed embodiments, the EO system is not moved to provide a wide FOR. If the camera is fixed in position and there is a single EO imager, then the FOR equals the FOV. However, for example, if four EO sub-systems that have the different orientations as shown in FIG. 1A have their respective image data combined together, the wide FOV shown in FIG. 1A can be obtained without physically moving any of the EO sub-systems. In the embodiment shown in FIG. 1A:

$FOR_x$=(FOV extent of EO sub-system 142 in the $+X$ direction)+(FOV extent of EO sub-system 144 in the $-X$ direction, and $FOR_y$=(FOV extent of EO sub-system 143 in the $+Y$ direction)+(FOV extent of EO sub-system 141 in the $-Y$ direction).

For example, as known in the art, in order to catch/intercept a target moving at Mach 1.7, the interceptor (e.g., missile seeker 100) needs a FOR extent of 35 degrees and to move at Mach 3.0. FOR is thus a mission-specific system aspect, and the cameras and arrangement of cameras may be designed to provide a customized FOR extent that is more or less than 35 degrees. For example, EO sub-systems can be arrayed all over the missile or other vehicle to provide full spherical (360 degree) targeting and detection, if desired.

As noted above, portholes on the sides of fast moving vehicles such as missiles have been recognized by the Inventor to raise a plurality of different design challenges, including mechanical, thermal and aerodynamic-induced optical challenges. Regarding mechanical challenges, too many portholes can mechanically compromise the vehicle. By using wide FOV EO sub-systems (>10 degrees as compared to conventional cameras that provide a maximum FOV of 1 to 2 degrees), disclosed fixed EO systems can sacrifice some pixel-per-degree resolution to provide the desired FOR typically with only three or four EO sub-systems, thus addressing the mechanical challenge. Electronic zoom can be employed to simulate narrow FOV functionality, such as target magnification.

Thermal challenges are raised due to heating of the optical windows over the portholes during movement of the vehicle, which can cause aberration, where the heating can be particularly significant for missiles due to frictional heating at supersonic speeds (e.g., reaching 600° F. (about 315° C.) to 800° F. (about 425° C.) for Mach 3.2 at 75,000 feet. Such thermal challenges can be addresses by disclosed embodiments including cooling grooves, hollow optical windows including cooling fluids, and embedded cooling tubes (e.g., pipes, embedded channels), as described below relative to FIGS. 3A-C, respectively. Aerodynamic-induced optical challenges can be addressed by adaptive optics compensation, analogous to compensation used with astronomical telescopes, such compensation using false stars and a mirror that either flexes or is formed from a plurality of smaller, adjustable minors (which can be adjusted as necessary to remove turbulent effects).

The cameras in fixed EO imaging sub-systems 141, 142, 143 and 144 in one embodiment can be focal plane array (FPA) cameras which can directly capture a 2-D image data projected by its lens onto its image plane. As known in the art, a FPA camera may also be referred to as a staring array, staring-plane array, or focal-plane and comprise an image sensing device including an array (typically rectangular) of light-sensing pixels at the focal plane of a lens. One particular example of FPAs that may be used with disclosed embodiments comprises a 640×512 mid-wave IR FPA with a 20-micron pixel pitch.

Conventional missile seekers are typically radar only or EO only, with some technology beginning to attempt to include both. In the conventional EO-only missile seeker, the tip is quasi-aerodynamic (i.e. usually spherical), providing good missile speed and range for sway space for gimbaled EO-seeker performance which views through the tip. However, this conventional EO missile seeker arrangement typically results in displacement of the radome off the missile tip in cases where radomes are employed.

Missile seeker 100 does need an EO sub-system at its tip 111. Instead, the array of fixed EO sub-systems 141, 142, 143 and 144 are positioned in the side of the dome 110 along the missile's long axis which frees up the space behind the tip 111 of the missile seeker 100 to accommodate radome placement. In addition, there are no moving parts required. Furthermore, the tip 111 of the missile seeker 100 can be asymmetrical (i.e., as it would ideally be for a ramjet missile with a scoop) without impacting EO performance. Disclosed embodiments thus simultaneously provide high aerodynamic and EO performance in a cost-effective, and efficient manner. Although not needed, an EO sub-system can also be optionally positioned near the tip 111 if desired.

In the embodiment shown in FIG. 1A the fixed EO imaging sub-systems 141, 142, 143 and 144 comprise 35° FOV F/0.8 FLIR cameras. In this embodiment, where two fixed EO imaging sub-systems are in each plane, for example, the respective EO sub-systems provide a maximum combined FOR when they are tilted away from one another 17.5 degrees. More generally, the fixed EO imaging sub-systems include 2 or more fixed EO imaging sub-systems that are arranged about the long axis (missile axis) in the sides of the missile seeker 100 and are oriented (angled) to provide the desired FOR. Although not shown in FIG. 1A, optical windows are secured over the plurality of portholes 121, 122, 123 and 124.

The optical windows can be flat monolithic windows, or conformal windows in which fixed corrector optics are generally then included (e.g., von Kármán corrector optics) and placed between the optical window and the EO sub-systems in order to correct aberrations introduced by the conformal window. As used herein, a "flat optical window" refers to a plane-parallel plate. Flat optical windows produce essentially no angular deviation of light (visible, infrared, or otherwise), which is optically desirable. A flat optical window as used herein includes up to a minor amount of wedge (i.e., non-parallel surfaces) typical for the manufactured item of less than 10 arc seconds. A flat optical window is unlike a conformal dome, which the Inventor has recognized can introduce severe wavefront distortions. In a typical embodiment, the flat optical window is an unsegmented window to ensure that pupil-splitting effects will not be present. The optical windows can comprise a variety of different optically transmissive materials, such as sapphire, ALON™, or spinel.

Figure 1B:
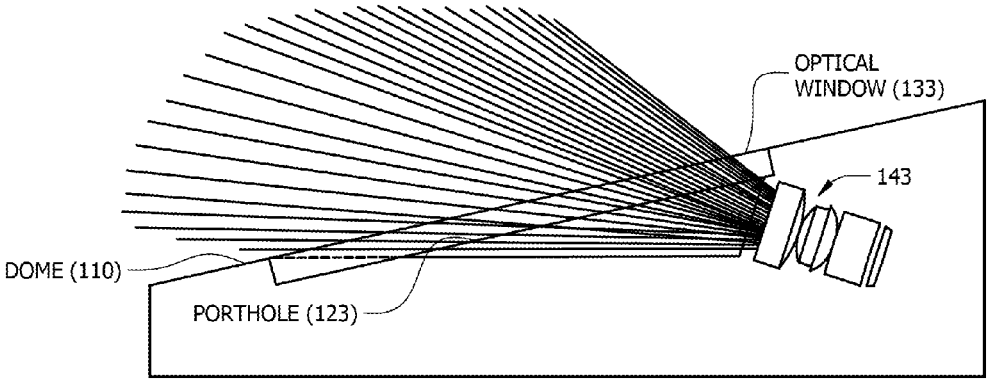
FIG. 1B is a side view depiction showing one of the fixed EO imaging sub-systems in FIG. 1A aligned to its monolithic flat optical window formed over a porthole in the side of the dome in action, according to a disclosed embodiment.

FIG. 1B is a side view depiction showing one of the fixed EO imaging sub-systems 143 in FIG. 1A aligned to its monolithic flat optical window 133 formed over a porthole 123 in the dome 110 in action, according to a disclosed embodiment. The flat window 133 is of sufficient thickness to prevent bowing due to aerodynamic forces on its exterior. In one particular embodiment the footprint hypotenuse of the optical window 133 is ≈8.2" (inches) in length, the optical window is 0.4" thick, elliptical in shape (8.2"×4.0") and angled at 77°. A 35 degree FOV provided by fixed EO imaging sub-system 143 is also shown.

Figure 1C:
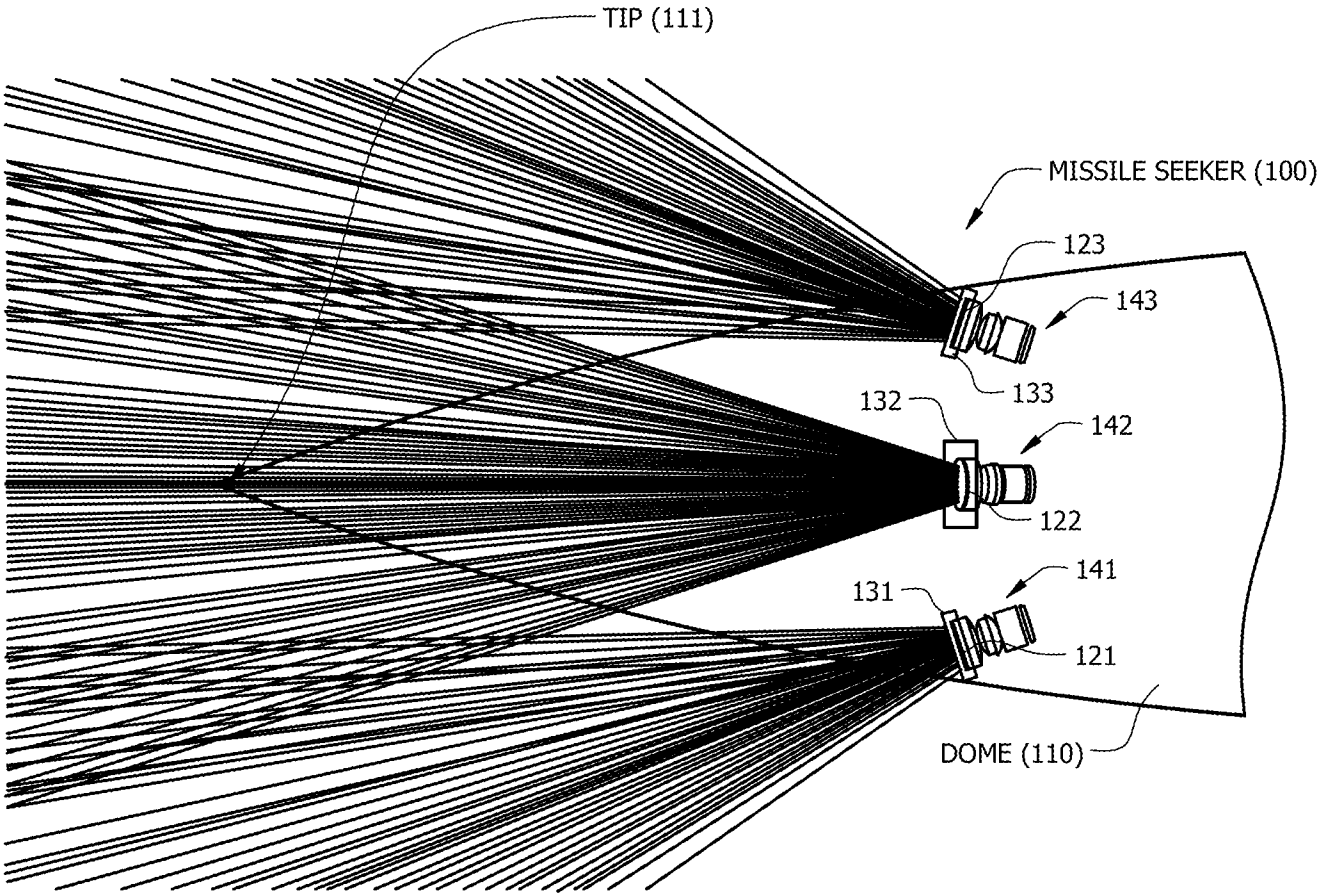
FIG. 1C is a side view depiction of the missile seeker depicted in FIG. 1A, according to a disclosed embodiment.

FIG. 1C is a side view depiction of the missile seeker depicted in FIG. 1A, according to a disclosed embodiment. The fixed EO imaging sub-systems are shown angled at 17.5 degrees to provide overlapping field-of views for respective fixed EO imaging sub-systems.

Figure 2A:
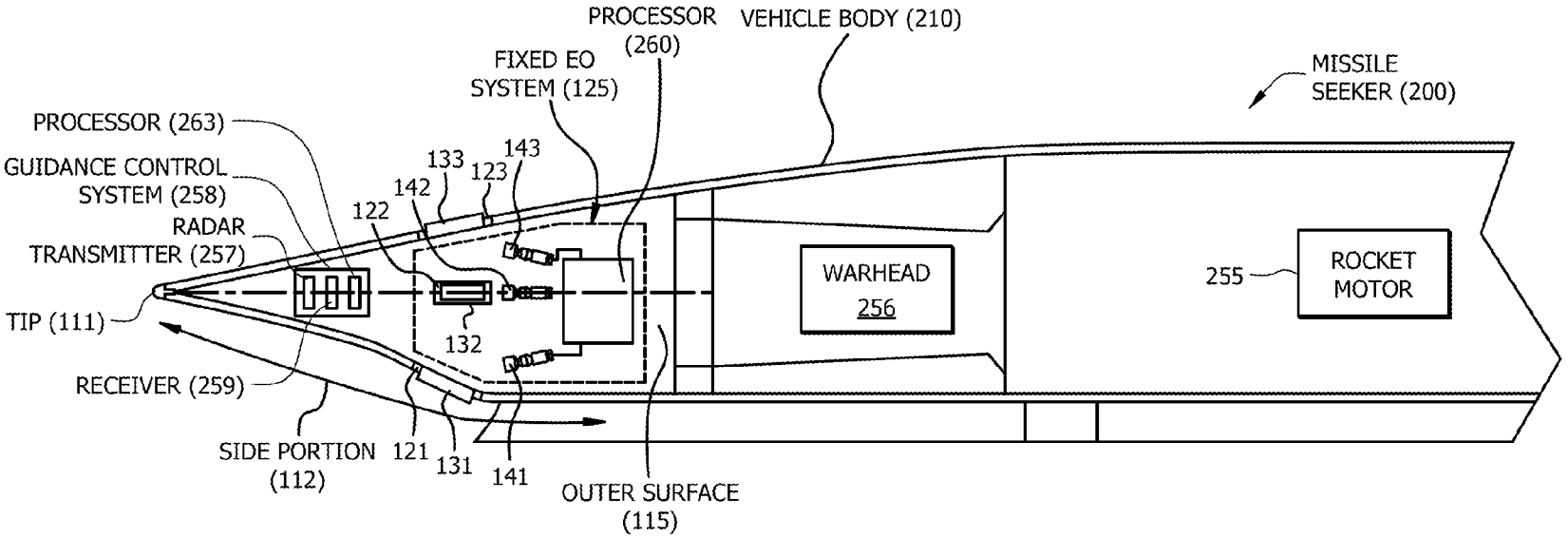
FIG. 2A is an inner revealed side view depiction of an example vehicle shown as a missile seeker having both EO and RF imaging, according to a disclosed embodiment.

FIG. 2A is longitudinal section depiction of an example vehicle shown as a missile seeker 200 having both EO and RF imaging. The fixed EO system can be used for a seeker for laser-guided munitions, where the EO system receives electromagnetic (e.g. IR) radiation, and the image data obtained provides a target-seeking function for the laser-guided munition (e.g., laser guided bomb, missile, torpedo, or a precision artillery munition). The missile seeker 200 is also shown including a radar system comprising radar transmitter 257 and radar receiver 259 (e.g., an RF radar system for long-range seeking/targeting).

The missile seeker 200 comprises a vehicle body 210 having an outer surface 115 including a front portion which includes a tip 111 and a side portion 112. The side portion 112 includes a plurality of portholes, shown as portholes 121, 122, 123 and 124, having optical windows 131, 132, 133 and 134 over the portholes 121, 122, 123 and 124, respectively. Portholes 121-124 allow IR transmission therethrough since the vehicle body is generally non-IR transmissive. Propulsion source shown as a rocket motor 255 is within the vehicle body 210 for propelling the missile seeker 200.

A processor 260 is coupled to receive the image data from the plurality of fixed EO imaging sub-systems 141-144 for combining the image data to provide composite image data spanning the full FOR.

The missile seeker 200 shown is a dual-missile seeker since it includes a fixed EO-based imaging system disclosed herein and a radar-based seeker comprising a guidance control system 258 comprising a radar transmitter 257 and receiver 259 coupled to a processor 263 positioned near the tip 111 of the missile seeker 200. The radar-based seeker is for long-range targeting while the fixed EO-based imaging system 125 is for short-range targeting.

The missile seeker 200 shown can be a fighter-launched supersonic missile designed to strike short-, medium- and long-range air-to-air and air-to-ground targets. Fixed EO system 125 provides the EO seeker portion for the missile seeker 200.

Missile seeker 200 can include an internal laser designator associated with the respective EO imaging sub-systems 141, 142, 143 and 144. As known in the art, when a target is marked by a laser designator, the beam is not continuous. Instead, a series of coded pulses of laser light are fired. These signals bounce off the target (e.g. into the sky), where they are detected by the seeker, which steers itself towards the center of the reflected signal. Alternatively, internal lasers may be excluded and an external laser designator may be used with missile seeker 200.

Missile seeker 200 is shown including a warhead 256. Guidance control system 258 can implement a radar-based homing guidance system. Embodied as an active homing system, target illumination is supplied by a component carried in the missile seeker 200, such as the radar transmitter 257 shown. The radar signals transmitted from the missile seeker 200 by radar transmitter 257 are reflected off the target back to the receiver 259 in the missile seeker 200. These reflected signals give the missile seeker 200 information such as the target's distance and speed. This information lets the guidance control system 258 compute the correct angle of attack to intercept the target.

Figure 2B:
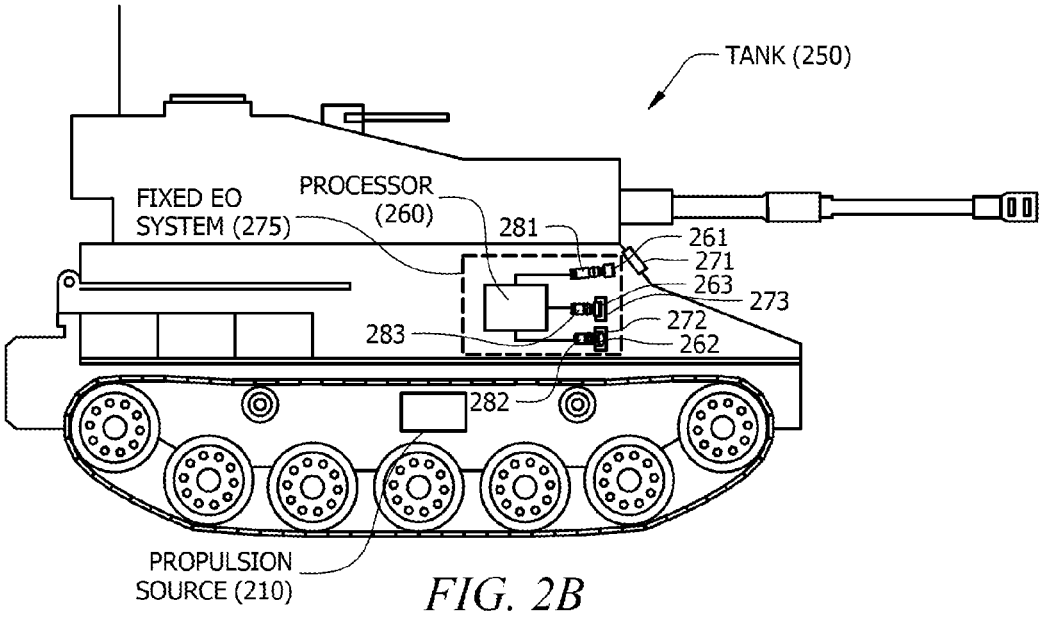
FIG. 2B is a depiction of a vehicle shown as a tank including an EO imaging system, according to a disclosed embodiment.

FIG. 2B is a depiction of a vehicle shown as a tank 250 including a disclosed fixed EO imaging system 275, according to a disclosed embodiment. Fixed EO imaging system 275 is positioned below the turret and is thus affixed to fixed portions of the tank 250, and comprises EO imaging sub-systems 281 (for viewing from the fixed front surface), 282 (for viewing from the fixed near side surface), and 283 (for viewing from the fixed far side surface). EO imaging sub-system 281 views from optical window 261 that is over porthole 271, EO imaging sub-system 282 views from optical window 262 that is over porthole 272, and EO imaging sub-system 283 views from optical window 263 that is over porthole 273. The outputs of EO imaging sub-systems 281, 282 and 283 are all coupled to processor 260 which can combine image data and provide composite image data spanning the needed FOR for tank. Although not shown, tank 250 can also include an EO imaging sub-system positioned at or near the fixed portion of the rear of the tank 250. Tank 250 includes a propulsion source 210, which generally comprises an engine. As noted above, other exemplary vehicles that can benefit from disclosed scanning imaging systems include missiles, torpedoes, bombs, airplanes, helicopters, and trucks.

Figure 3A:
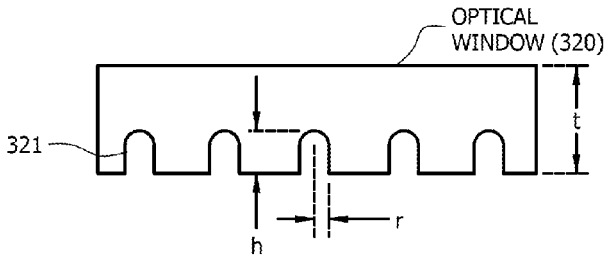
FIGS. 3A-C show depictions of some example window cooling structures for cooling optical windows that can be used with disclosed embodiments.
Figure 3B:
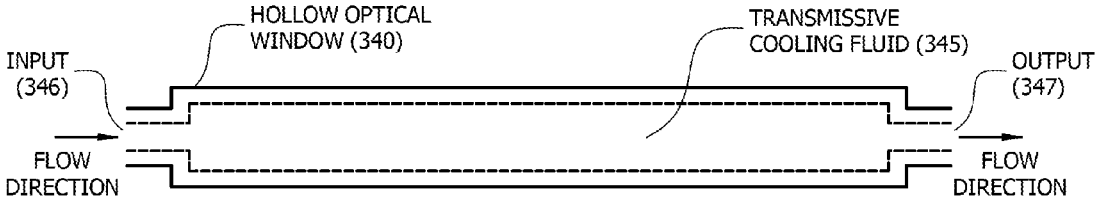
Figure 3C:
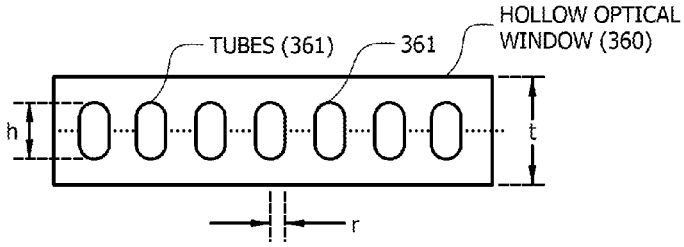

FIGS. 3A-C show depictions of some example window cooling structures for cooling optical windows. FIG. 3A depicts an optical window 320 including a plurality of notched cooling grooves 321 having a height (h) in the thickness (t) direction. The radius of the cooling grooves is shown as "r". This embodiment provide passive cooling by increasing surface area of the optical window. Cooling grooves 321 may be located in areas of lower relative stress and should generally have a smooth profile. The h/t ratio is generally from 0.1 to 0.5, and the h/r ratio is generally from 1 to 4.

FIG. 3B depicts a hollow optical window 340 thick enough to maintain structural integrity having an optically transmissive cooling fluid 345 therein. The example flow direction of the optically transmissive cooling fluid 345 within the hollow optical window 340 is shown by arrows near its input 346 and its output 347. The optically transmissive cooling fluid 345 picks up heat as it traverses from the input 346 to the output 347. Although not shown, the optically transmissive cooling fluid 345 is generally pumped, including to a heat exchanger for cooling before being returned to the input 346 of the hollow optical window 340.

FIG. 3C depicts a hollow optical window 360 having thin embedded cooling tubes 361 that can include an optically transmissive cooling fluid therein. The thickness (t) direction is shown, with the embedded cooling tubes 361 having a height (h), and a radius shown as "r". The ratio of h/t is generally from 0.4 to 0.8 and h/r from 2 to 8. In a typical application, the material for the hollow optical window 360 will provide sufficient thermal conductivity to allow the embedded cooling tubes 361 to be in thermal contact with a heat transfer surface.

The embodiments shown in FIGS. 3A-C may be combined. For example, a hollow optical window can be filled with cooling fluids and cooling tubes.

When embodied as a missile seeker, a significant advantage provided by fixed EO imaging system disclosed herein over conventional gimbaled EO system-based missile seekers is that conventional gimbaled systems require ample amounts of sway space in order to sweep the entire optical system including the camera through a FOR and therefore can impose expensive packaging constraints on other system attributes. A significant performance improvement is also attained. When compared to conventional dome-gimbal missile configurations, disclosed missile seeker provides a wider FOR and consistent aberration correction. While spherical dome-gimbal configurations can provide high-quality images, their FORs are comparatively limited relative to those provided by the disclosed embodiments because a missile is essentially a long cylinder with a short diameter, so that the FOR for a fully gimbaled system is limited by the missile's diameter and by the length of its optical system. Embodied as a seeker missile, although the EO systems are described above specifically for seeking/targeting, disclosed EO systems can also simultaneously function as a threat-warning system provided that the image-and-signal processing and electronics support this capability. For example, such support can be provided by adequate integration times, threat-band filtering, power and space for additional electronics boards.

Disclosed embodiments are expected to have fairly broad applications due to the advantages described above. Disclose embodiments eliminate the need for any moving parts (gimbals, Risley prisms), and embodied as a missile seeker, enable radome placement at the missile tip, permit the use of any missile tip shape—symmetric or otherwise—without impacting electro-optical system design or performance and provide an unobstructed wide FOR.

Figure 4:
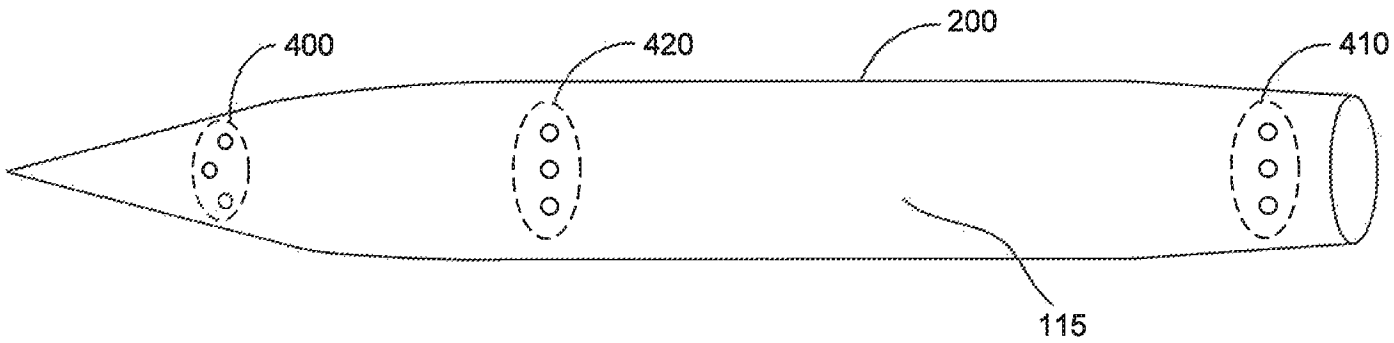
FIG. 4 shows a non-limiting depiction of various locations where portholes or apertures may be located on the vehicle.

FIG. 4 shows a non-limiting depiction of various locations where portholes or apertures may be located on the vehicle. Instead of having one gimbaled (or other mechanically scanned) EO imaging system having a single optical window at the front/tip of the vehicle 200 looking down the vehicle's long axis, the multiple fixed EO systems may be arrayed about the long axis of the vehicle by adding portholes, certain groups of portholes collectively identified as 400, 410, 420, positioned on the sides of the vehicle (thus off the vehicle's long axis) on an outer surface 115 such that the needed FOR is obtained. Placing portholes or apertures off the vehicle's long axis is not limited to placing the portholes or apertures where the EO systems are front forward looking because as disclosed above, portholes or apertures may be located on a fixed portion of the rear of the vehicle, provided that they are not looking down the vehicle's long axis.

While various disclosed embodiments have been described above, it should be understood that they have been presented by way of example only, and not as a limitation. Numerous changes to the disclosed embodiments can be made in accordance with the Disclosure herein without departing from the spirit or scope of this Disclosure. Thus, the breadth and scope of this Disclosure should not be limited by any of the above-described embodiments. Rather, the scope of this Disclosure should be defined in accordance with the following claims and their equivalents.

Although disclosed embodiments have been illustrated and described with respect to one or more implementations, equivalent alterations and modifications will occur to others skilled in the art upon the reading and understanding of this specification and the annexed drawings. While a particular feature may have been disclosed with respect to only one of several implementations, such a feature may be combined with one or more other features of the other implementations as may be desired and advantageous for any given or particular application.

The terminology used herein is for the purpose of describing particular embodiments only and is not intended to be limiting to this Disclosure. As used herein, the singular forms "a," "an," and "the" are intended to include the plural forms as well, unless the context clearly indicates otherwise. Furthermore, to the extent that the terms "including," "includes," "having," "has," "with," or variants thereof are used in either the detailed description and/or the claims, such terms are intended to be inclusive in a manner similar to the term "comprising."

Unless otherwise defined, all terms (including technical and scientific terms) used herein have the same meaning as commonly understood by one of ordinary skill in the art to which this Disclosure belongs. It will be further understood that terms, such as those defined in commonly-used dictionaries, should be interpreted as having a meaning that is consistent with their meaning in the context of the relevant art and will not be interpreted in an idealized or overly formal sense unless expressly so defined herein.

I claim:

1. A vehicle having electro-optic (EO) imaging, comprising:

a vehicle body having an outer surface including a fixed front surface, a fixed back surface, a fixed near side surface, or a fixed far side surface said fixed front surface, fixed back surface, fixed near side surface, or fixed far side surface including at least one porthole, of a plurality of portholes arrayed about a location where a long axis of the vehicle body is located;

a propulsion source within said vehicle body for moving said vehicle, and a fixed EO imaging system having a field-of-regard (FOR) comprising a plurality of fixed EO imaging sub-systems arrayed within said vehicle body, wherein said plurality of fixed EO imaging sub-systems each have a different field-of-view (FOV) for providing a portion of said FOR and comprise:

a camera affixed within said vehicle body, and an optical window secured over ones of said plurality of portholes for transmitting electromagnetic radiation received from one of said plurality of portions of said FOR to said camera, wherein said camera generates image data representing one of said portions of said FOR therefrom, and a processor coupled to receive said image data from said plurality of fixed EO imaging sub-systems for combining said image data to provide composite image data spanning said FOR.

2. The vehicle of claim 1, wherein said plurality of fixed EO imaging sub-systems are wide FOV EO imaging sub-systems that all provide a FOV of ≥10 degrees.

3. The vehicle of claim 1, wherein said optical windows include at least one cooling structure selected from cooling grooves, hollow optical windows having optically transmissive cooling fluids therein and hollow optical windows having cooling tubes therein.

4. The vehicle of claim 1, wherein said vehicle comprises a military vehicle selected from a missile, a torpedo, a bomb, an airplane, a helicopter, a tank, or a truck.

5. The vehicle of claim 1, wherein said vehicle comprises a missile, and said long axis is a missile axis, wherein said front surface comprises a tip, and wherein said plurality of fixed EO imaging sub-systems are arrayed along at least one of said side surfaces about said missile axis and not at said tip.

6. The vehicle of claim 5, wherein said missile includes a radome that provides said tip and extends from said tip to length along said missile axis, wherein said plurality of portholes extend through said radome along at least one of said side surfaces.

7. The vehicle of claim 5, wherein said missile further comprises a radar seeker for long range seeking.

8. The vehicle of claim 1, wherein said optical windows comprise flat optical windows.

9. A missile, comprising:

a body having an outer surface including a front portion including a tip and a side forward facing portion, said side forward facing portion of the front portion including a plurality of apertures;

a rocket motor within said outer surface for propelling said missile;

an electro-optic (EO) imaging system within said outer surface comprising:

a fixed EO imaging system having a field-of-regard (FOR) comprising a plurality of fixed EO imaging sub-systems arrayed within said body, wherein said plurality of fixed EO imaging sub-systems each have different fields-of-view (FOV) for providing a portion of said FOR and comprising:

a camera affixed within said body, and an optical window secured over ones of said plurality of apertures for transmitting electromagnetic radiation received from one of said plurality of portions of said FOR to said camera, wherein said camera generates image data representing one of said portions of said FOR therefrom, and a processor coupled to receive said image data from said plurality of fixed EO imaging sub-systems for combining said image data to provide composite image data spanning said FOR.

10. The missile of claim 9, wherein said plurality of fixed EO imaging sub-systems are wide FOV EO imaging sub-systems that all provide a FOV of ≥10 degrees.

11. The missile of claim 9, wherein said optical windows include at least one cooling structure selected from cooling grooves, hollow optical windows having optically transmissive cooling fluids therein and hollow optical windows having cooling tubes therein.

12. The missile of claim 9, wherein said plurality of fixed EO imaging sub-systems are not arrayed at said tip.

13. The missile of claim 12, wherein said missile includes a radome that provides said tip and extends from said tip to length along said missile axis, wherein said plurality of portholes extend through said radome along said side portion.

14. The missile of claim 9, wherein said missile further comprises a radar seeker for long range seeking.

15. The missile of claim 9, wherein said optical windows comprise flat optical windows.

* * * * *